United States Patent [19]

Miller et al.

[11] Patent Number: 4,987,274

[45] Date of Patent: Jan. 22, 1991

[54] COAXIAL CABLE INSULATION AND COAXIAL CABLE MADE THEREWITH

[75] Inventors: Terry L. Miller, Gilbert, Ariz.; William R. Zdanis, Jr., Danielson, Conn.; Graham A. Woerner, Mesa, Ariz.; Allen F. Horn, III, Danielson, Conn.

[73] Assignee: Rogers Corporation, Rogers, Conn.

[21] Appl. No.: 364,909

[22] Filed: Jun. 9, 1989

[51] Int. Cl.[5] ..... H01B 11/18; H01B 3/00

[52] U.S. Cl. ..... 174/102 R; 174/110 F; 174/110 FC; 428/325

[58] Field of Search ..... 174/102 R, 110 F, 110 FC; 428/325; 524/544, 545

[56] References Cited

U.S. PATENT DOCUMENTS

| | | | |
|---|---|---|---|
| 3,054,761 | 9/1962 | Moore et al. | 524/491 |
| 3,556,161 | 8/1965 | Roberts | 138/141 |
| 3,679,614 | 7/1972 | Shah et al. | 521/62 |
| 3,843,570 | 10/1974 | Murayama | 521/62 |
| 4,335,180 | 6/1982 | Traut | 174/68.5 |
| 4,515,992 | 5/1985 | Gupta | 174/102 R |
| 4,560,829 | 12/1985 | Reed et al. | 174/102 R |
| 4,692,287 | 9/1987 | Timmons | 264/41 |
| 4,839,221 | 7/1989 | Asaumi et al. | 428/325 X |
| 4,849,284 | 7/1989 | Arthur et al. | 174/68.5 X |

*Primary Examiner*—Morris H. Nimmo

*Attorney, Agent, or Firm*—Fishman, Dionne & Cantor

[57] ABSTRACT

A ceramic filled fluoropolymer composite coaxial cable insulation and the coaxial cable made therefrom is presented. In accordance with the present invention, the coaxial cable insulation is comprised of 60–25% fluoropolymer that is fibrillatable, 40–75% ceramic filler and a void content which is effective to provide a dielectric constant of approximately less than 2.30. In a preferred embodiment of the present invention, the coaxial cable insulative composite comprises approximately 40 weight percent PTFE, 60 weight percent fused amorphus silica and a void volume percent of between 30 and 60. Also in certain preferred embodiemnts, the composite may include 1–4% by weight of microfiberglass filler and the ceramic filler may be coated with a silane coating. The provision of the void volume is an important feature of the present invention and acts to substantially lower the overall dielectric constant of the insulative composite. Still another important feature of this invention is the provision of an effective amount of ceramic filler (silica) so as to reduce the coefficient of thermal expansion (CTE) to a CTE approximating that of copper. This results in a coaxial cable having electrical properties which are more temperature stable than the prior art; and coaxial cable assemblies having improved thermomechanical stability relative to the prior art.

47 Claims, 3 Drawing Sheets

COAXIAL CABLE INSULATION AND COAXIAL CABLE MADE THEREWITH

BACKGROUND OF THE INVENTION

This invention relates generally to a highly filled fluoropolymeric jacketing compound for use as wire insulation. More particularly, this invention relates to a ceramic filled fluoropolymeric wire insulative material having uniform material properties over a wide temperature range for use in coaxial cable. This invention also relates to the coaxial cable made from this ceramic filled fluoropolymeric insulative material.

Coaxial cable is used in a variety of sophisticated and demanding electronic applications. As is well known, coaxial cable comprises an inner metal conductor surrounded by a layer of cable insulation, all of which is jacketed by a metal ground layer. In addition, an outer insulative protective covering may be applied to the ground jacketing. Presently, the cable insulation is comprised of any of a number of polymeric materials including fluoropolymeric materials such PTFE. Unfortunately, such prior art insulative compounds suffer from several important drawbacks and deficiencies. One of the more serious problems associated with prior art coaxial cable insulation is the lack of uniformity of material properties with changes in temperature. Typically, the dielectric constant varies greatly over the temperature range in which the cable is required to operate. Also, the coefficient of thermal expansion of these prior art cables is relatively high. This results in an undesirable tendency to creep under mechanical or thermal stresses as well as to undesirable fluctuation in the dielectric constant of the insulation leading to changes in the electrical operation of the cable. An example of a coaxial cable insulative material exhibiting such undesirable properties is a solid PTFE insulation.

SUMMARY OF THE INVENTION

The above-discussed and other problems and deficiencies of the prior art are overcome or alleviated by the ceramic filled fluoropolymer composite coaxial cable insulation (and the coaxial cable made therefrom) of the present invention. In accordance with the present invention, the coaxial cable insulation is comprised of 60–25% fluoropolymer that is fibrillatable, 40–75% ceramic filler and a void content which is effective to provide a dielectric constant of approximately less than 2.30. In a preferred embodiment of the present invention, the coaxial cable insulative composite comprises approximately 40 weight percent PTFE, 60 weight percent fused amorphus silica and a void volume percent of between 30 and 60. Also in certain embodiments, the composite may include 1–4% by weight of microfiberglass filler and the ceramic filler may be coated with a silane coating.

The provision of the void volume is an important feature of the present invention and acts to substantially lower the overall dielectric constant of the insulative composite. The void volume may be formed by a variety of known methods. One Preferred method is the use of fugitive fillers which can be removed from the composite prior to fabrication of the cable assembly. These fillers act to create microporous cells within the insulation. Examples of such fugitive fillers include fine grains of water-leachable salts or other water soluble materials or oxidizable polymers which can be removed from the insulation by thermal oxidation or decomposition at a temperature below the melting point of the fluoropolymer matrix. A preferred oxidizable polymer is polymethylmethacrylate. Still another method of forming the voids is to mechanically punch tiny holes in the insulation during assembly.

Still another important feature of this invention is the provision of an effective amount of ceramic filler (silica) so as to reduce the coefficient of thermal expansion (CTE) to a CTE approximating that of copper. This results in a coaxial cable having electrical properties which are more temperature stable than the prior art; and coaxial cable assemblies having improved thermomechanical stability relative to the prior art.

The novel coaxial cable insulation of the present invention thus overcomes the problems of the prior art by providing a cable insulation which has both low thermal expansion as well as a low and stable dielectric constant over a wide temperature range.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

The present invention relates to a cable insulation which finds particular utility in coaxial cable applications. The insulation for coaxial cable of the present invention comprises a composite material of ceramic filler 40–75% (by weight) and a fluoropolymeric material 60–25% (by weight) which is fibrillatable. In an important feature-of the present invention, the fluoropolymeric composite material is provided with a void volume which is effective to reduce the dielectric constant of the composite to less than 2.30. The preferred fluoropolymer matrix is PTFE and the preferred ceramic filler is fused amorphous silica powder. The present invention also preferably includes a silane coating which is applied to the ceramic filler. The present invention may also include other fiber fillers such as microfiberglass in an amount of 1–4% by weight.

Figure 1:
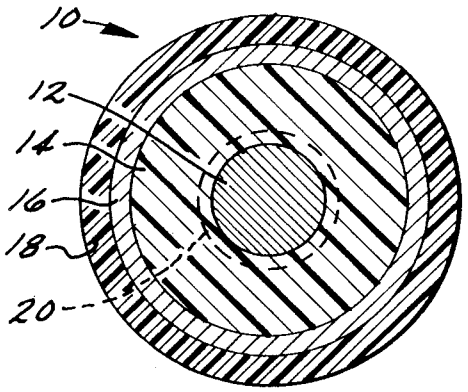
FIG. 1 is a cross sectional elevation view of coaxial cable incorporating the novel insulation of the present invention.

Turning now to FIG. 1, a cross-sectional view through a length of coaxial cable is identified generally at 10. Cable 10 has a well known configuration including a central conductor 12 (typically copper), a layer of insulation 14 (which is the subject matter of the present invention) surrounding conductor 12, and an outer metal ground jacket 16 surrounding insulation 14. An electrically insulative sheath 18 may optionallY cover metal jacketing 16.

The cable insulation 14 of the present invention has some similarities in composition to the circuit board substrate material described in U.S. Pat. No. 4,849,284. That patent is assigned to the assignee hereof and the entire contents thereof is incorporated herein by reference. The circuit substrate material of U.S. Pat. No. 4,849,284 comprises a highly ceramic filled fluoropolymer wherein the ceramic is coated with silane. However, this circuit material has a dielectric constant of about 2.8 which is higher than is desirable in a coaxial cable insulation application.

The insulative compound of the instant invention is prepared in a manner similar to that described in aforementioned U.S. Pat. No. 4,849,284. Once mixed, the insulation of the present invention may be formed into thin sheets for wrapping about the cable or alternatively the present invention may be directly paste extruded about the cable wire.

As mentioned, preferably the ceramic (silica) surface is treated with a silane as described in U.S. Pat. No. 4,849,284 which will act to render said surface hydrophobic.

While the method of making the present invention (which is discussed in detail hereinafter and in the several examples) will provide a sufficient pore volume to lower the dielectric constant to at least 2.30, if desired the dielectric constant of the cable jacket may be even further decreased by increasing the void volume. This may be accomplished in a variety of known procedures using removable fillers such as described in U.S. Pat. No. 3,556,161. Removable fillers may be broadly classified according to their mode of removal. For example, some fillers may be removed by solvent action and include water soluble materials such as salts and the like. Other fillers may be dissolved by chemical action while still other fillers may decompose to volatile components on heating to temperatures below the melting point of the fluoropolymer matrix. Such fillers include ammonium chloride, ammonium carbonate and polymers such as polymethylmethacrylate (PMMA). The step of removing the fillers is done after the extrusion and calendering steps discussed below. Two preferred types of removable or sacrificial fillers are finely divided water soluble salts and finally divided polymethylmethacrylate. The salt is leached out of the sheet by emerging into water. The PMMA is removed by thermal degradation at a temperature well below the melting point of the fluoropolymer matrix (PTFE). Still another method of providing additional void volume in the insulative composite is to mechanically punch tiny holes in the sheet before it is wrapped into a cable assembly.

As with the use of sacrificial fillers, mechanically punching the sheet will also achieve a higher void volume and lower the dielectric constant and dissibation factor of the insulation. Of course, punching holes in a sheet will only be useful where the cable insulation is wrapped about the inner conductor; and not for manufacturing methods involving paste extrusion. A method of preparing such an insulative sheet suitable for wrapping is a follows: First, the several ingredients are prepared as discussed in U.S. Pat. No. 4,849,284. Thereafter the process is essentially that of extrusion and calendering the paste into a thin sheet. This sheet can be purged of any lubricants needed to make the extrusion and calendering possible. If desired, this dried sheet can be further treated by sintering the fluoropolymer into a more consolidated continuous phase by exposing the sheets to 340° C. or greater. The sintering results in some slight lessening of the porosity but does leave significant pore volume. While the sintering step acts to increase the tensile strength, sintering is not a necessary step in the manufacturing of the present invention as the unsintered material is sufficiently strong and compression resistant. Of course the void volume of the sheet can be further increased by any of the methods described above.

As mentioned, rather than forming the insulation in sheets and wrapping about a cable, the insulation of the present invention may also be paste extruded onto a cable. In this case, the fluoropolymer (which is preferably PTFE) and the ceramic filler may either be blended as dried powders or may be blended in dispersion using PTFE aqueous dispersion and coagulation. The dry components of the furnish are blended with a suitable lubricant which is present in the amount of about 15 to 30 percent by weight of the final lubricated paste. It has been discovered that dipropyleneglycol (DPG) is unusually well suited for this purpose. Attempts to lubricate the highly filled PTFE with industry standard paste extrusion higher boiling paraffins yielded weak extrudates that were barely cohesive and exhibited excessive extrusion pressures. In contrast, the dipropyleneglycol exhibited a unique suitability as a lubricant due to its ability to wet both the PTFE and interact with the treated filler.

The blended paste is then extruded through standard commercial paste extrusion equipment with dies designed for cable jacketing. The jacketed cable is then heated in an oven to remove the lubricant and leave the PTFE/silica/void composite upon the wire as wire jacketing. The lubricant must be removed to achieve satisfactory electrical, physical and thermal properties. The cable jacket may then be sintered by raising its temperature in order to exceed the melting point of the PTFE (340° C.) or may be left in the unsintered state as described above. As mentioned, the sintering slightly increases the tensile strength and the density of the formulations. If sacrificial fillers have been added to the extrudate, said fillers are removed from the wire jacket after extrusion in a similar manner as described above.

The coaxial cable insulation made from the highly ceramic filled fluoropolymer of the present invention will have a very low temperature coefficient of dielectric constant (TCDK), low creep and a coefficient of thermal expansion matched to that of copper. All of these properties are highly desirable in a number of coaxial cable applications and presently are not found in any one known coaxial cable insulation material. The insulative composite of the present invention will have a much reduced tendency to creep under mechanical or thermal stress. This leads to cable with an increased resistance to thermal cycling induced degradation of electrical properties due to deformation of the dielectric material.

Still another advantage of the present invention is that the low CTE of the ceramic filled fluoropolymer will improve the solderability of the cable and improve cable yields.

It is presently believed that paste extrusion is the preferred manufacturing method over conductor wrapping. When prepared as a paste extrusion, the dielectric material of the present invention may be extruded directly onto the center conductor in a continuous process thus making it considerably cheaper than conductor wrapping. Direct paste extrusion is also likely to produce a cable of superior physical properties and reduced proclivity to forming air gaps between the dielectric and center conductor than cable formed by wrapping the conductor with a sheet product of similar composition.

Also, an adhesive layer comprised of polyethylene or a fluoropolymeric film such as FEP is preferably applied to the central conductor 12 to provide a stronger bond between conductor 12 and insulation 14. This bonding film is indicated by the dashed line at 20.

As mentioned, the cable insulation of the present invention contains a ceramic (preferably silica) to reduce the coefficient of thermal expansion (CTE) from that of pure PTFE (approximately 100 ppm/° C. to 250 ppm° C., depending on the temperature range over which it is measured) to a CTE in the range of metallic copper (approximately less than 100 ppm/° C. and more preferably less than 40 ppm/° C.). Copper itself has a CTE of 17.7 ppm/° C. This reduced CTE feature of the insulating material of this invention is an important aspect of the present invention. Approximately matching the CTE of the dielectric material to that of copper results in an invention with at least two distinct advantages over the present state of the art of either solid PTFE jacketed cable or "microporous" PTFE jacketed cable. These advantages include:

1. The electrical properties of the present invention are more temperature-stable than those of the prior art. Cable assemblies made with the present invention possess better "phase stability" than those of the prior art. The present invention also has a low "thermal coefficient of dielectric constant" (TCDK).
2. Semi rigid cable assemblies made with the present invention are more "thermomechanically" stable than the prior art. This means that soldered connectors will not fail during temperature cycling from −65° C. to +125° C. with the present invention, while those of the prior art will fail under these circumstances. This also means that the "VSWR" (voltage standing wave ratio) of cable assemblies made with the present invention is more stable upon thermal cycling than the prior art.

EXAMPLE 1 - PHASE STABILITY OF CABLE ASSEMBLIES MADE WITH THE PRESENT INVENTION

1216 Grams of DuPont Teflon 6C fine powder, 1984 grams of fused amorphous silica powder (treated with 1% by weight phenyltrimethoxysilane) and 800 grams of dipropylene glycol were blended together in a Patterson Kelly "Vee" blender. This material was paste extruded through an 0.088" diameter die onto 0.037" diameter center conductor. Standard paste extrusion wire jacketing equipment manufactured by Jennings International Corporation was used for this process. The center conductor was stainless steel, plated with copper and subsequently silverplated. The jacketed wire was placed in an oven for approximately one hour at 450° F. to remove the dipropylene glycol. The diameter of the cable jacket was 0.120".

The jacketed center conductor was fabricated into a semi-rigid coaxial cable assembly. The copper jacket has an outside diameter of 0.141" and inside diameter of 0.119". The electrical properties of the cable assembly were tested on a Hewlett-Packard 8409 Network Analyzer. The measured assembly impedance was 50 ohms. The dielectric constant of the insulating material was 2.08 based on the measured impedance and assembly dimensions.

Figure 2:
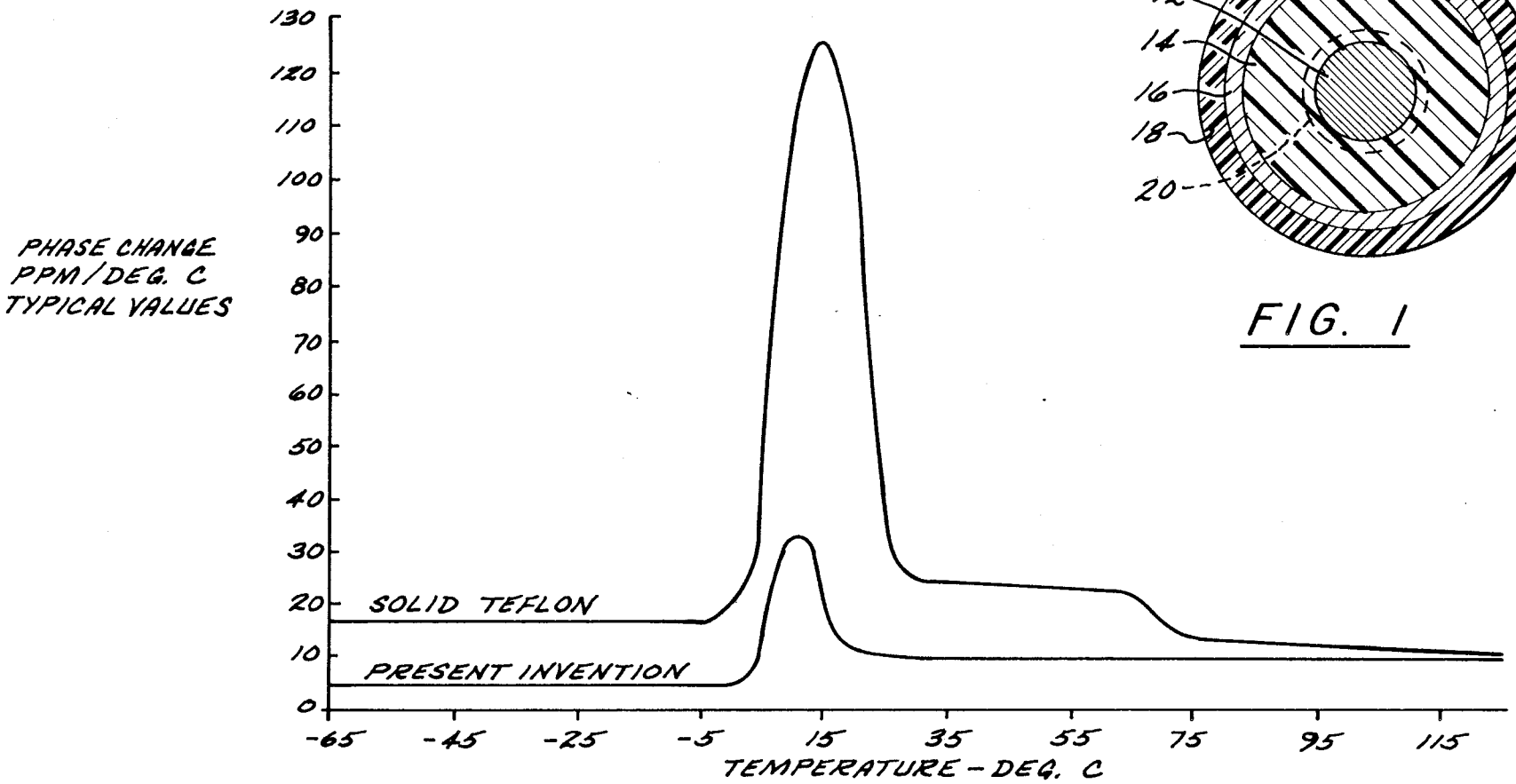
FIG. 2 is a graph depicting temperature vs phase change for the present invention and prior art coaxial cable.

The cable assembly was placed in a thermal cycling chamber and tested for phase angle change over a temperature range of −65° C. to +115° C. Phase angle change (in ppm/° C.) versus temperature is plotted in FIG. 2 and compared to that of a standard solid PTFE-jacketed Mil-C-17 0.141" OD semi-rigid cable assembly. As is clear from a review of FIG. 2, the rate of phase angle change of the assembly fabricated with the present invention is far less than that of the prior art. This phase stability will result in improved system performance and obviate or simplify temperature compensating circuitry.

EXAMPLE 2 - THERMOMECHANICAL STABILITY OF COAXIAL CABLE ASSEMBLIES FABRICATED WITH THE PRESENT INVENTION

Figure 3:
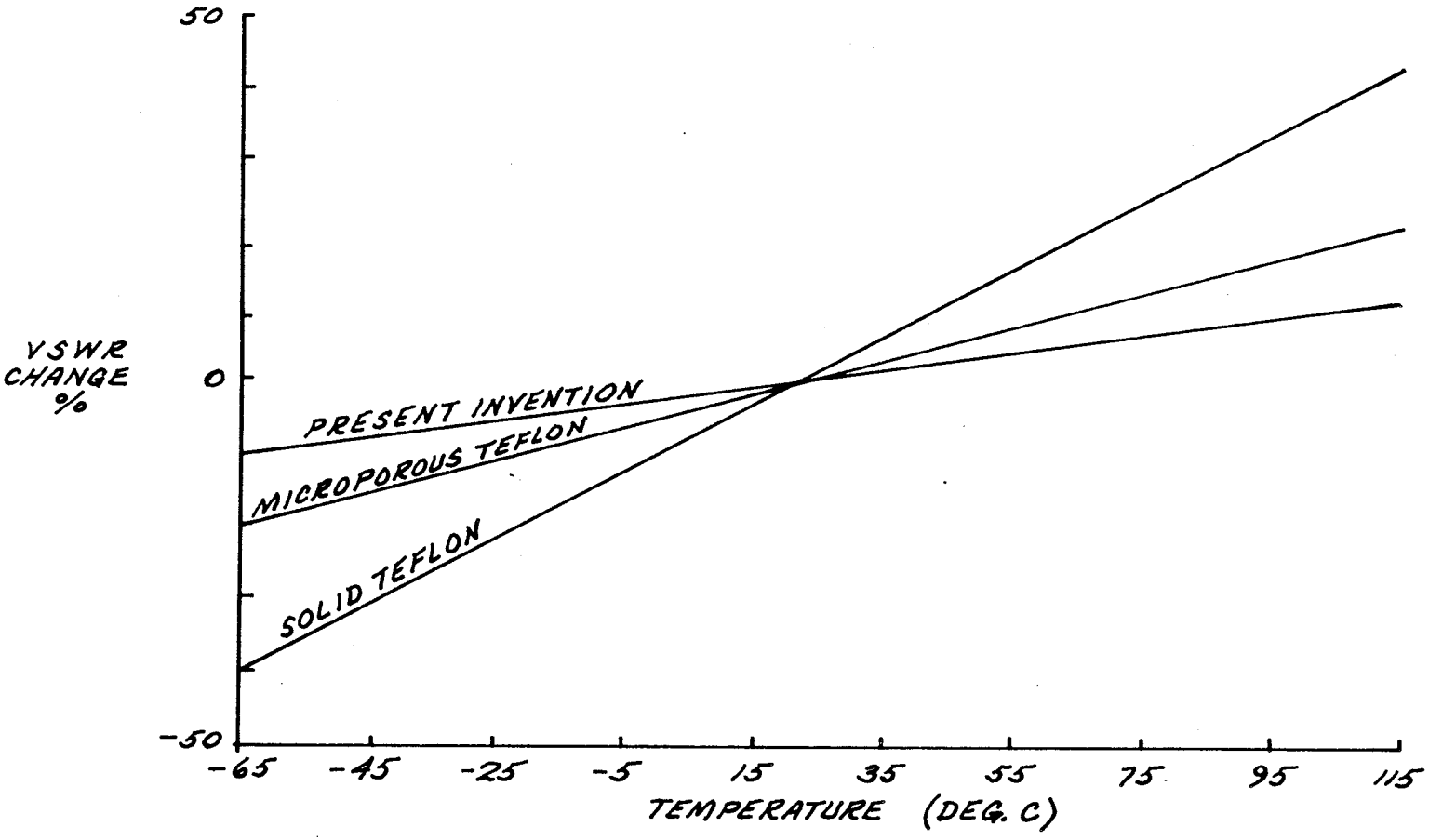
FIG. 3 is a graph depicting temperature vs VSWR change percent for the present invention and prior art coaxial cable.

Jacketed center conductor was fabricated in the same manner as described in Example 1 and made into a similar coaxial cable assembly. This assembly was tested in the thermal cycling chamber with the Hewlett Packard 8409 over a temperature range of −65° C. to +115° C. to determine the change in the measured Voltage Standing Wave Ratio (VSWR) with temperature. Percent VSWR change versus temperature is plotted in FIG. 3 for the present invention along with typical values for solid PTFE-jacketed center conductor and microporous PTFE jacketed center conductor. The change in VSWR with temperature of cable fabricated with the present invention is significantly lower than that of the prior art, due to the reduced coefficient of thermal expansion of the dielectric material of the present invention. This leads to an improvement in VSWR of greater than 20%.

EXAMPLE 3 - LOW TEMPERATURE COEFFICIENT OF DIELECTRIC CONSTANT OF THE PRESENT INVENTION

It will be appreciated that the temperature-stable electrical properties, such as dielectric constant, of the present invention impart significant advantages over the prior art. This Example 3 demonstrates the low temperature coefficient of dielectric constant of the compositions of matter used in the present invention.

1900 grams of ICI AD 704 grade PTFE dispersion were blended in 92,000 grams of water with 3050 grams of fused amorphous silica (treated with 1% by weight Dow Corning 6100 silane) and 50 grams of Manville Corporation's 104E microglass fiber. The slurry was coagulated with approximately 50 grams of poly(ethyleneimine). The coagulum was dewatered on a hand sheet mold and dried in an oven. The dried crumb was lubricated in a twin shell vee blender with 1097 grams of dipropylene glycol. In order to facilitate testing, this material was fabricated into 0.060" thick panels.

Figure 4:
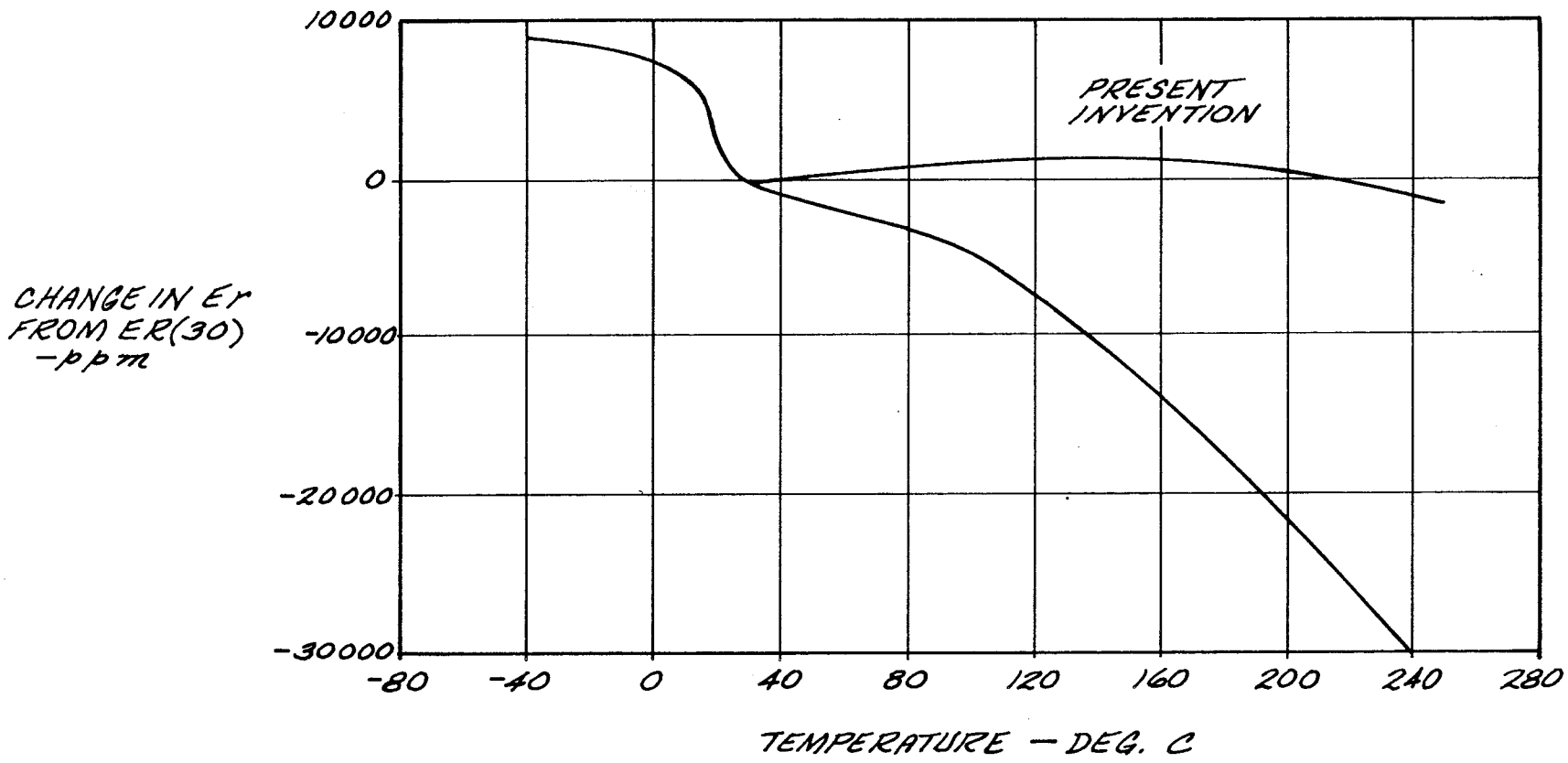
FIG. 4 is a graph depicting temperature vs change in dielectric constant for the present invention and prior art coaxial cable insulation.

The panels were tested for dielectric constant over temperatures ranging from −80° C. to +240° C. The plotted results in FIG. 4 demonstrate the stability of dielectric constant with respect to temperature of this composition of matter.

EXAMPLE 4 - THERMAL CYCLING STABILITY OF CABLE ASSEMBLIES FABRICATED USING THE PRESENT INVENTION

Four twelve-inch long cable assemblies were fabricated as described in Example 1 using Omni-Spectra 2001-5003 SMA plugs and 2002-5013 SMA jacks. For purposes of comparison, four similar cable assemblies were also fabricated using standard Mil-C-17 solid PTFE cable.

Two separate constant temperature chambers were set to temperatures of +125° C. (Chamber 1) and −65° C. (Chamber 2). All cable assemblies were thermal cycled for 20 cycles according to the schedule below:

(1) Place assembly in chamber 1, allow to soak for 30 minutes.

(2) Remove assembly and immediately (within five minutes) place sample in chamber 2 and allow to soak for 30 min.

(3) Remove assembly and immediately (within five minutes) place sample in chamber 1.

Steps 1 to 3 constitute 1 cycle. All cable assemblies fabricated using the present invention remained intact after 20 thermal cycles, due to the low coefficient of thermal expansion of the dielectric material of the present invention. All four cable assemblies fabricated with the Mil-C-17 solid PTFE jacketed cable failed due to broken solder joints at the end connectors.

EXAMPLE 5 - RANGE OF COMPOSITIONS OF UTILITY IN FABRICATION OF THE PRESENT INVENTION

It will be appreciated that a range of compositions similar to those of the above examples will exhibit the desirable properties of low coefficient of thermal expansion and temperature stability of electrical properties of varying degrees.

The preferred range of fused amorphous silica content of the present invention is chosen to approximately match the coefficient of thermal expansion of metallic copper. Matching the CTE of the dielectric material to that of copper will yield the greatest thermomechanical stability of cable assemblies fabricated with the present invention, while also imparting comparatively stable electrical properties over a range of operating temperatures. Compositions falling within the preferred range contain from 55 to 70% fused amorphous silica by weight and 45 to 30% poly(tetrafluoroethylene) polymer by weight.

Increasing the fused amorphous silica content of these formulations reduces the coefficient of thermal expansion of the resulting composite material. The reduced CTE will increase the stability of electrical properties with changing temperature. However, compositions containing more than approximately 75% fused amorphous silica by weight will have poor physical properties such as flexibility, tensile strength and tensile elongation. This approximately establishes the upper limit of silica content of the present invention.

Reducing the fused amorphous silica content of these formulations will increase the coefficient of thermal expansion of the resulting composite material. The CTE of composite materials made containing lower amounts of fused amorphous silica will still exhibit greater mechanical stability and more thermally stable electrical properties than the prior art. However, below approximately 40% fused amorphous silica by weight, the CTE has increased to greater than 100 ppm/° C. over the temperature range of −50° C. to +125° C. The desirable characteristics of the present invention will be considerably diminished with a dielectric insulation with a CTE as high as 100 ppm/° C. Thus, the lower limit of silica content of the present invention is approximately 40% silica by weight. As mentioned, a preferred composite in accordance with this invention includes a ceramic filled content effective to reduce the CTE to less than 40 ppm/° C.

Inclusion of porosity in the PTFE-silica composite is also an important feature of the present invention to reduce the dielectric constant of the composite material to less than 2.30. The porosity may be achieved by presence of the lubricant which is subsequently dried off, natural entrainment of air due to the high filler content or may be augmented (as described hereinabove) by the use of additional "fugitive" fillers such as soluble salts that may be leached out of the furnish after the cable has been extruded and dried or poly (methylmethacrylate) powder that can be removed by exposure to high temperature. In the case of tape-wrapped cable, the porosity may be augmented by mechanically punching.

Porosity may be determined from the measured specific gravity of the composite material. The specific gravity of fused amorphous silica and poly(tetrafluoroethylene) polymer are both approximately 2.17. Thus, for composite materials fabricated from PTFE and fused amorphous silica in all proportions, a specific gravity of less than 2.17 is due to porosity. The volume fraction of porosity in the composite material may be calculated as:

$$vol.\ frac.\ porosity = 1 - sp.g./2.17$$

The below examples illustrate a portion of the range of slilica contents and porosities that result in composite material with superior cable properties. Recipes for example materials are listed below in Table 1.

TABLE 1

Recipes for PTFE-Silica Dielectric Insulating Material Dry Basis Weight Fractions of the Various Components

| ID | PTFE | Silica | PMMA Powder |
|---|---|---|---|
| R69-3 | 0.38 | 0.62 | 0.0 |
| R69-2 | 0.285 | 0.466 | 0.242 |
| R69-1 | 0.339 | 0.554 | 0.107 |
| R86-1 | 0.550 | 0.450 | 0.0 |
| R86-2 | 0.462 | 0.378 | 0.160 |
| R86-4 | 0.398 | 0.432 | 0.170 |
| R86-6 | 0.300 | 0.700 | 0.0 |
| R86-8 | 0.250 | 0.750 | 0.0 |
| R86-9 | 0.208 | 0.622 | 0.170 |

Compositions R69-1, R69-2 and R69-3 were extruded onto 0.0365" silver plated, copper clad stainless steel center conductor as described in Example 1. All three samples were dried in an oven set to 450° F. for two hours to remove the lubricant. Samples R69-2 and R69-1 were baked for an additional 10 hours at 600° F. to remove PMMA powder by depolymerization. Cable assemblies were fabricated as described in Example 1 and tested with the Hewlett-Packard 8409 network analyzer to measure electrical properties. The dielectric constant was calculated from the physical dimensions of the cable and the measured impedance. The specific gravity was measured by water displacement. The measured specific gravities, lengths and cable impedances are listed below in Table 2 with the calculated dielectric constant.

TABLE 2

Specific Gravities and Dielectric Constants of the Present Invention

| ID | Sp. Grav | Length | Impedance Ohms | Dielect. Const |
|---|---|---|---|---|
| R69-3A | 1.43 | 18.7" | 49.5 | 2.08 |

TABLE 2-continued

| Specific Gravities and Dielectric Constants of the Present Invention | | | | |
|---|---|---|---|---|
| ID | Sp. Grav | Length | Impedance Ohms | Dielect. Const |
| R69-3B | 1.43 | 10.1" | 49.5 | 2.08 |
| R69-3C | 1.43 | 65.1" | 49.5 | 2.08 |
| R69-3D | 1.42 | 15.4" | 50.0 | 2.04 |
| R69-2A | 1.31 | 30.5" | 49.5 | 1.74 |
| R69-2B | 1.28 | 82.3" | 48.5 | 1.70 |
| R69-1A | 1.03 | 42.2" | 50.0 | 1.62 |
| R69-1B | 0.99 | 51.5" | 50.5 | 1.60 |

The R86 series of compositions was lubricated in a twin shell vee blender with dipropylene glycol and extruded into 0.140" diameter solid rod. All compositions were dried for two hours in an oven at 450° F. to remove the lubricant. Those samples containinq PMMA powder were dried for an additional 10 hours at 600° F. to depolymerize and remove the PMMA. Specific gravities of all compounds were measured by water displacement. Dielectric constants were calculated from the known composition and specific gravity of the composite material using the established correlation of "method II" described in "Predicting Dielectric Properties",: T. D. Newton, IPC-TP-587, IPC 29th Annual Meeting, Apr. 6–10, 1989. This correlation is accurate to within 15% of the actual value, and for PTFE-fused amorphous silica composites, predicts a value slightly higher than is actually measured, as is demonstrated by the data included for R69-3 and R69-2 (to be compared with direct measurements in Table 2). The specific gravities, calculated dielectric constants and coefficients of thermal expansion of these compositions of matter are listed in Table 3.

TABLE 3

| Measured Sp. G. and Calculated DK of various compositions | | | |
|---|---|---|---|
| ID | Sp. G. | Dielec. Const. | CTE (ppm/°C.) |
| R86-1 | 1.53 | 2.15 | 85 |
| R86-2 | 1.25 | 1.91 | 85 |
| R86-4 | 1.54 | 2.23 | 60 |
| R86-6 | 1.37 | 2.25 | 11 |
| R86-8 | 1.36 | 2.29 | — |
| R86-9 | 1.06 | 1.97 | — |
| R69-3 | 1.43 | 2.21 | 22 |
| R69-2 | 0.99 | 1.79 | 22 |

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In a coaxial cable comprising a central conductor, insulation surrounding the central conductor, and a ground jacket surrounding the insulation, the insulation defining a composite including:
   a fluoropolymeric matrix having a weight percent of between about 60 to 25 of the overall composite;
   at least one ceramic filler in said fluoropolymeric matrix in a weight percent of between about 40–75 of the overall composite;
   a void content in the composite effective to reduce the dielectric constant of the composite to less than about 2.30.

2. The coaxial cable of claim 1 wherein:
   said fluoropolymeric matrix comprises polytetrafluoroethylene.

3. The coaxial cable of claim 1 wherein:
   said ceramic filler comprises silica.

4. The coaxial cable of claim 1 wherein:
   said ceramic filler comprises fused amorphous silica.

5. The coaxial cable of claim 2 wherein:
   said ceramic filler comprises fused amorphous silica.

6. The coaxial cable of claim 1 including:
   a silane coating on said ceramic filler.

7. The coaxial cable of claim 1 including:
   microglass fiber having a weight percent of between about 1–4 of the overall composite.

8. The coaxial cable of claim 1 wherein:
   the composite is sintered.

9. The coaxial cable of claim 1 wherein:
   the composite is unsintered.

10. The coaxial cable of claim 1 wherein:
   said ceramic filler is present in an amount effective to lower the coefficient of thermal expansion of the composite to about less than 100 ppm/° C.

11. The coaxial cable of claim 10 wherein:
   said ceramic filler is present in an amount effective to lower the coefficient of thermal expansion of the composite to about less than 40 ppm/° C.

12. The coaxial cable of claim 1 including:
   at least one lubricant in the composite.

13. The coaxial cable of claim 12 wherein:
   said lubricant comprises dipropylene glycol.

14. The coaxial cable of claim 1 wherein:
   the composite comprises at least one sheet, said sheet being wrapped about the central conductor.

15. The coaxial cable of claim 14 including:
   holes punched in said sheet to further increase said void content.

16. The coaxial cable of claim 1 wherein:
   the composite is paste extruded onto the central conductor.

17. The coaxial cable of claim 1 including:
   fugitive materials being added to the composite to further increase said void content.

18. The coaxial cable of claim 1 wherein:
   said fluoropolymeric matrix comprises a fibrillatable fluoropolymer.

19. In a coaxial cable comprising a central conductor, insulation surrounding the central conductor, and a ground jacket surrounding the insulation, the insulation defining a composite including:
   a fluoropolymeric matrix having a weight percent of between about 60 to 25 of the overall composite;
   a ceramic filler in said fluoropolymeric matrix, said ceramic filler being present in an amount effective to lower the coefficient of thermal expansion of the composite to about less than 100 ppm/° C.

20. The coaxial cable of claim 19 including:
   a void content in the composite effective to reduce the dielectric constant of the composite to less than about 2.30.

21. The coaxial cable of claim 19 wherein:
   said fluoropolymeric matrix comprises polytetrafluoroethylene.

22. The coaxial cable of claim 19 wherein:
   said ceramic filler comprises silica.

23. The coaxial cable of claim 19 wherein:
   said ceramic filler comprises fused amorphous silica.

24. The coaxial cable of claim 21 wherein:
   said ceramic filler comprises fused amorphous silica.

25. The coaxial cable of claim 19 including:
   a silane coating on said ceramic filler.

26. The coaxial cable of claim 19 including:

microglass fiber having a weight percent of between about 1–4 of the overall composite.

27. The coaxial cable of claim 19 wherein:

filler is between about 40–75 weight percent of the overall composite.

28. The coaxial cable of claim 19 wherein:

said ceramic filler is present in an amount effective to lower the coefficient of thermal expansion of the composite to about less than 40 ppm/° C.

29. The coaxial cable of claim 19 wherein:

the composite comprises at least one sheet, said sheet being wrapped about the central conductor.

30. The coaxial cable of claim 20 wherein the composite comprises at least one sheet, said sheet being wrapped about the central conductor, and including:

holes punched in said sheet to further increase said void content.

31. The coaxial cable of claim 19 wherein:

the composite is paste extruded onto the central conductor.

32. The coaxial cable of claim 20 including:

fugitive materials being added to the composite to further increase said void content.

33. The coaxial cable of claim 19 wherein:

said fluoropolymeric matrix comprises a fibrillatable fluoropolymer.

34. In a coaxial cable comprising a central conductor, insulation surrounding the central conductor, and a ground jacket surrounding the insulation, the insulation defining a composite including:

a fluoropolymeric matrix;

a ceramic filler in said fluoropolymeric matrix, said ceramic filler being present in an amount effective to lower the coefficient of thermal expansion of the composite to about less than 100 ppm/° C.

35. The coaxial cable of claim 34 including:

a void content in the composite effective to reduce the dielectric constant of the composite to less than about 2.30

36. The coaxial cable of claim 34 wherein:

said fluoropolymeric matrix comprises polytetrafluoroethylene.

37. The coaxial cable of claim 34 wherein:

said ceramic filler comprises silica.

38. The coaxial cable of claim 34 wherein:

said ceramic filler comprises fused amorphous silica.

39. The coaxial cable of claim 34 including:

a silane coating on said ceramic filler.

40. The coaxial cable of claim 34 including:

microglass fiber having a weight percent of between about 1–4 of the overall composite.

41. The coaxial cable of claim 34 wherein:

said ceramic filler is between about 40–75 weight percent of the overall composite.

42. The coaxial cable of claim 34 wherein:

said ceramic filler is present in an amount effective to lower the coefficient of thermal expansion of the composite to about less than 40 ppm/° C.

43. The coaxial cable of claim 34 wherein:

the composite comprises at least one sheet, said sheet being wrapped about the central conductor.

44. The coaxial cable of claim 35 wherein the composite comprises at least one sheet, said sheet being wrapped about the central conductor, and including:

holes punched in said sheet to further increase said void content.

45. The coaxial cable of claim 34 wherein:

the composite is paste extruded onto the central conductor.

46. The coaxial cable of claim 35 including:

fugitive materials being added to the composite to further increase said void content.

47. The coaxial cable of claim 34 wherein:

said fluoropolymeric matrix comprises a fibrillatable fluoropolymer.

* * * * *